US006823597B2

(12) United States Patent
Larson

(10) Patent No.: US 6,823,597 B2
(45) Date of Patent: Nov. 30, 2004

(54) ARCHERY BOW SIGHT

(76) Inventor: Marlow W. Larson, 2735 S. 4050 W., Ogden, UT (US) 84401

( * ) Notice: Subject to any disclaimer, the term of this patent is extended or adjusted under 35 U.S.C. 154(b) by 0 days.

(21) Appl. No.: 10/191,047

(22) Filed: Jul. 2, 2002

(65) Prior Publication Data

US 2003/0000093 A1 Jan. 2, 2003

Related U.S. Application Data

(60) Provisional application No. 60/301,911, filed on Jul. 2, 2001.

(51) Int. Cl.[7] ..... F41G 1/467
(52) U.S. Cl. ..... 33/265
(58) Field of Search ..... 33/265; 124/87

(56) References Cited

U.S. PATENT DOCUMENTS 4,449,303 A 5/1984 Larson
4,910,874 A * 3/1990 Busch ..... 33/265
4,928,394 A 5/1990 Sherman
5,168,631 A 12/1992 Sherman
5,201,124 A 4/1993 Sherman
5,228,204 A * 7/1993 Khoshnood ..... 33/265
5,442,861 A 8/1995 Lorocco
5,657,740 A * 8/1997 Slates et al. ..... 124/87
5,676,122 A * 10/1997 Wiseby et al. ..... 124/87
5,685,081 A * 11/1997 Winegar ..... 33/265
6,401,347 B1 * 6/2002 Slates ..... 33/265

* cited by examiner

*Primary Examiner*—Christopher W. Fulton
(74) *Attorney, Agent, or Firm*—Brian C. Trask

(57) ABSTRACT

An improved sight for an archery bow providing a mechanism operable to convert a rotational input to a purely translational output. The mechanism may be adapted simultaneously and uniformly to adjust the windage of a plurality of sight pins. In another embodiment, the mechanism may be operable to adjust a vertical position of an individual sight pin carrying a fiber optic pickup.

14 Claims, 8 Drawing Sheets

ARCHERY BOW SIGHT

RELATED APPLICATIONS

This application claims the benefit under 35 U.S.C. 119(e) of the filing date of Provisional Application Ser. No. 60/301,911, filed Jul. 2, 2001, for "ARCHERY BOW SIGHT".

BACKGROUND

1. Field

This invention pertains to sight assemblies for use with archery bows. It is particularly directed to such assemblies which utilize rotatable elements to adjust the vertical position of illuminated sight pins.

2. State of the Art

Aiming sights of various designs are commonly used in the sport of archery. Such sights typically comprise an assembly, which includes a bracket supported by structure fixed to the handle riser of the bow. With the bow held in its normal position of use, its limbs are considered to be oriented approximately vertically. References in this disclosure to "vertical" or "horizontal" orientations are with reference to such vertical bow limbs. The sight bracket generally supports a plurality of vertically spaced sighting elements (often called "pins"), each of which extends approximately horizontally to terminate in an end (sometimes called a "sighting bead") near a vertical sight plane. Each sight element corresponds to a distinct target distance, depending upon its precise vertical position along the sight plane.

Various mechanisms have been relied upon to adjust the horizontal position of the sight plane or the sight beads. Such adjustments are advantageous to account for the influence of wind and/or the shooting idiosyncrasies of individuals, and are commonly referred to as "windage adjustments." Similarly, various mechanisms have been utilized to adjust the vertical positions of the respective sight elements. Such adjustments are commonly referred to as "distance adjustments." One class of mechanisms for providing distance adjustment capability mounts individual pins in an assembly which translates rotation of a knob into vertical linear motion, up or down. This arrangement is particularly advantageous, providing for infinite and stable adjustability superior to most other arrangements.

Representative of this class is the sighting assembly disclosed by U.S. Pat. No. 4,449,303, the disclosure of which is incorporated as a portion of this disclosure. The sighting elements of that assembly comprise pins individually threaded into a central bore of a cylindrical carriage element. Each carriage element is adjustable up and down within a particular slot of a bracket in a rack-and-pinion type of engagement. The carriage element has a knob portion and a pinion portion. The pinion portion engages a rack element within the slot. Rotation of the knob is thus translated into vertical adjustment, without affecting the horizontal (windage) adjustment of the sighting bead. Windage adjustment is made by turning individual pins within their respective cylindrical elements. In this construction, the pins inherently rotate during any adjustment of either elevation or windage. Because the pins are cylindrical, this rotation is immaterial to the functioning of the sight.

Both target shooting and hunting are frequently practiced under low light conditions in which visibility of the sight element becomes poor. There has thus evolved a variety of sight assemblies structured to gather ambient light to illuminate the sight beads. This light gathering function is generally performed by special plastic or glass elements. Notable among these light gathering/transmitting elements are fiber optic strands. U.S. Pat. Nos. 5,442,861; 5,201,124; 5,168,631 and 4,928,394, the disclosures of which are incorporated as a portion of this disclosure, identify a number of light gathering elements and sighting pin structures incorporating those elements. Incorporation of these elements in sight systems in which the pins rotate during either windage or distance adjustments has not been feasible, however, because of the necessity for the light gathering elements to remain in a fixed rotational orientation. This design constraint is particularly significant in the case of fiber optic strands.

BRIEF SUMMARY OF THE INVENTION

This invention provides a sight assembly for archery bows which is constructed to translate rotation of an adjustment knob into linear travel of a sighting pin, without rotating the pin. It is thereby feasible for the sighting pins to carry a light gathering element, including a fiber optic element. Preferred versions of the assembly provide for infinite windage adjustment of the sighting plane, also without rotating the sighting pins. Other embodiments provide a pin assembly wherein an adjustment knob is associated with a locking mechanism. In preferred arrangements, both the adjusting knob and the locking mechanism are structured for operation by a simple tool comprising an element of the sight assembly.

While this invention is described with primary focus upon rack and pinion arrangements, it is recognized that many alternative mechanical expedients are available to translate the rotation of an adjustment knob into linear motion of a sight pin. For example, a cylindrical element may be substituted for the pinion and a smooth slot may be substituted for the rack in the arrangements disclosed by the '303 patent. Frictional engagement of these substituted elements provides the same translation of knob rotation to linear pin travel, but in a less positive fashion. The improvement of this invention is broadly applicable to any structure operative to provide linear vertical movement of a sight pin in response to rotational movement of an adjustment fixture, such as a screw or knob.

Similarly, the windage adjustment feature of this invention may be provided by various mechanical arrangements. A screw thread assembly is generally preferred because of its simplicity and ease of manufacture and assembly. Any other mechanism capable of adjusting the position of the pins of the assembly along the horizontal sight plane without rotating the individual sight pins could be utilized. Among such arrangements are rack and pinion assemblies, belt drives, chain drives, piston drives and various fluid drive assemblies. It is even feasible to utilize a manually operable telescopic boom arrangement.

In a preferred embodiment of the invention, at least one mechanism is associated with the sight and operable to convert a rotatational user input into a purely translational output operable to adjust a component of the sight. A first preferred such mechanism is a windage adjustment mechanism operable simultaneously and uniformly to effect a horizontal adjustment of a plurality of sight pins. A second preferred such mechanism is an elevation adjustment mechanism operable to effect a vertical adjustment of at least one sight pin.

Preferred mechanisms generally include: a knob element adapted to receive rotational input from a user; a slide member configured and arranged in harmony with holding structure to resist rotation of the slide member and permit translational movement of the slide member with respect to the holding structure; and linkage structure between the knob and the slide member, with the linkage structure being operable to move the slide member responsive to rotation of the knob.

An operable elevation adjustment mechanism can include a plurality of sight pins carried on a base structure that is adapted for attachment, at a plurality of vertically disposed positions, to structure carried by a support arm of the sight assembly whereby to permit a simultaneous and uniform displacement of the pins in a vertical direction. One preferred elevation mechanism includes a pinion engaging a rack, with the pinion being operated by a driven interface adapted to receive a rotational driving input from a user effective to change a vertical position of a sight pin with respect to the sight. Since the sight pins do not rotate during their adjustment in elevation, it is feasible to dispose a light gathering element in association with a sight pin for purely vertical translation between first and second elevations.

It generally is desirable also to include a lock adapted to resist changes in the vertical position of the pin in an elevation mechanism. Such a lock can be operated by a lock interface that is adapted to receive rotational locking and unlocking input from a user. A convenient tool to make adjustments to a sight includes a wrench adapted on a first end to apply a rotational input to a lock interface. Ideally, the wrench will be adapted on a second end to apply a rotational input to a driven interface to effect an adjustment of a sight component. Some sights further include storage structure adapted to hold such a wrench in a snap-fit engagement.

BRIEF DESCRIPTION OF THE SEVERAL VIEWS OF THE DRAWINGS

In the drawings, which illustrate what are currently regarded as the best modes for carrying out the invention.

DESCRIPTION OF THE ILLUSTRATED EMBODIMENTS

Figure 1:
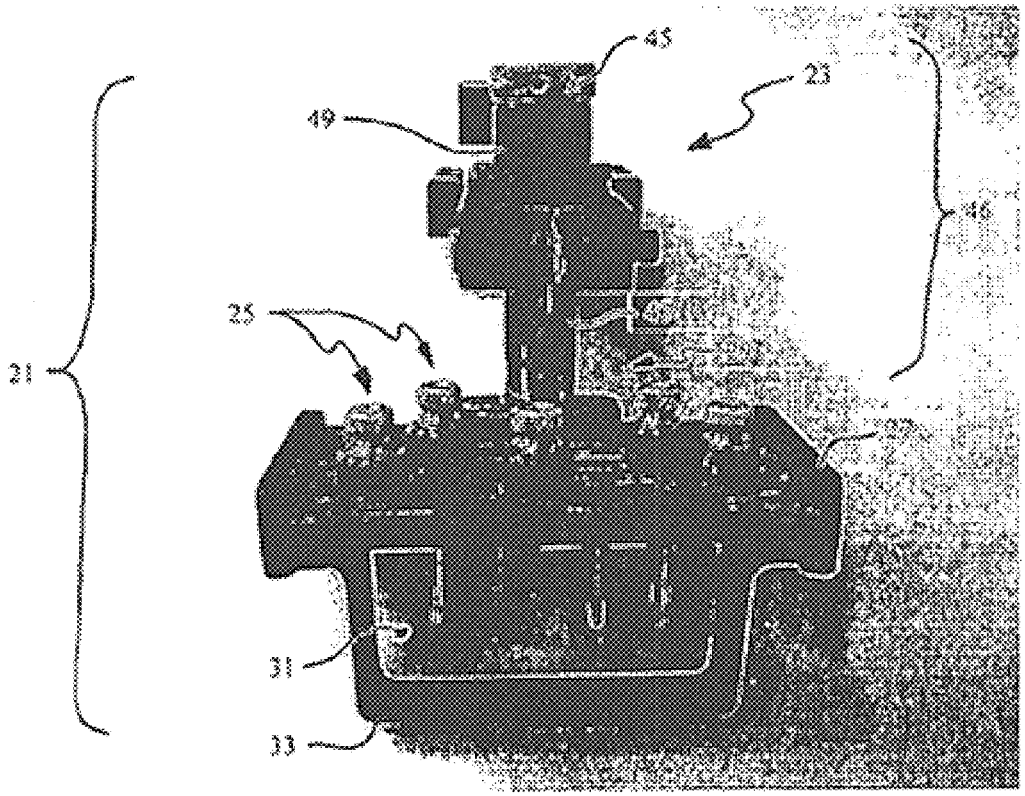
FIG. 1 is a pictorial view of a bow sight assembly of this invention.
Figure 2:
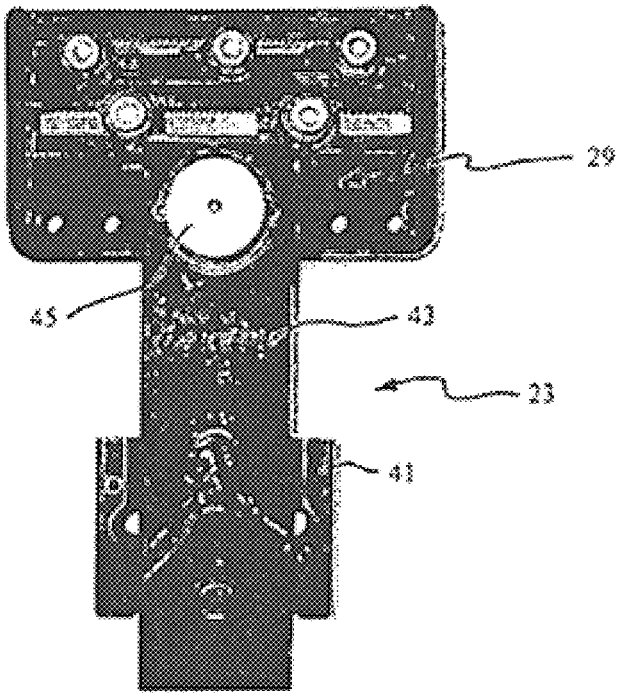
FIG. 2 is a plan view of the assembly of FIG. 1.
Figure 4:
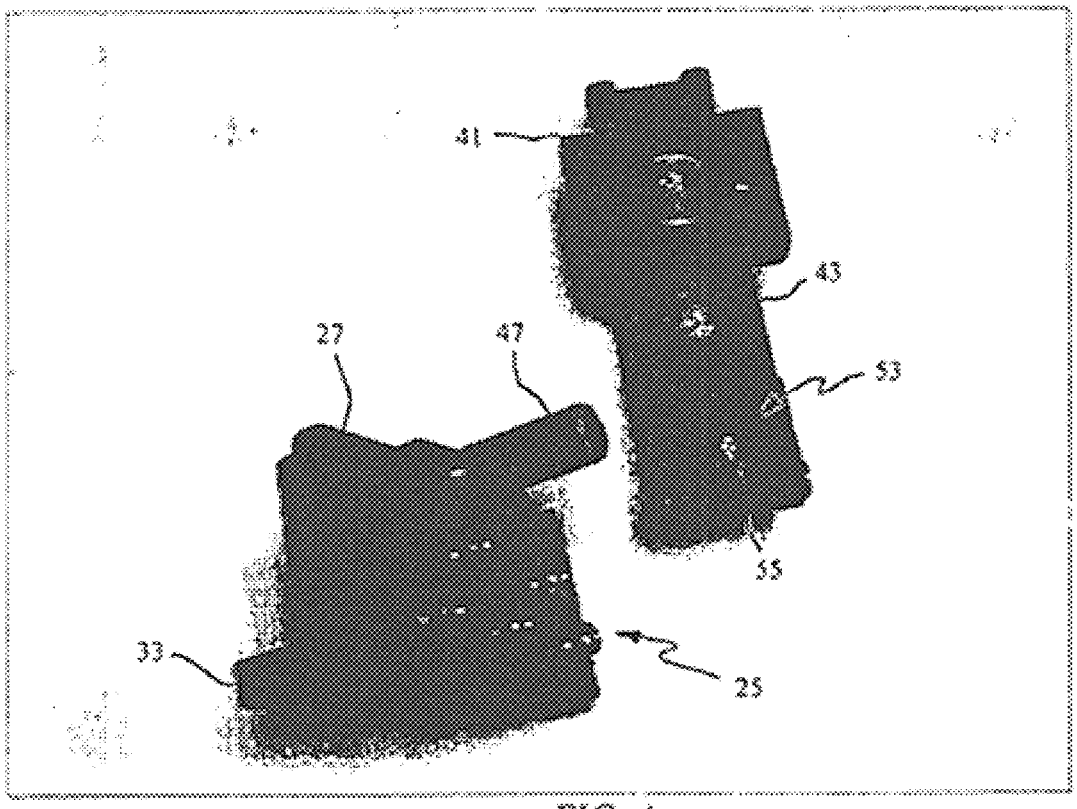
FIG. 4 is a pictorial view of the subassembly of FIG. 3 in association with a mounting sub assembly of the assembly of FIG. 1.

One preferred sight assembly, generally 21, illustrated by FIGS. 1, 2 and 4, includes a mounting structure, generally 23, constructed and arranged appropriately to attach the sight assembly 21 to the handle riser of an archery bow (not shown.) A plurality of sight pin assemblies, generally 25, typically are carried on a bracket 27 at the distal end of a boom assembly, generally 29, extending in cantilever fashion from the mounting structure 23. A sight window 31 is defined by a cage element 33 carried by the bracket 27. The cage element 33 and bracket 27 may be separate parts or integral. While a cage element 33 generally is desired to protect one or more pin assemblies 25 from incidental damage, a cage 33 is not essential for operation of the invention.

Referring to FIG. 2, the illustrated mounting structure 23 includes a fixture 41 adapted for connection to a handle riser (not shown), and an upstanding support element 43 detachably connectable to the fixture 41. In practice, these elements may be integral. As illustrated, the proximal end of the boom 29 carries a windage adjustment knob 45 of a windage adjustment mechanism, generally 46. Turning the knob 45 effects a linear movement (extension or retraction, depending upon direction of rotation of knob 45) of a peg component 47 from a housing component 49 of the boom assembly 29.

Figure 3:
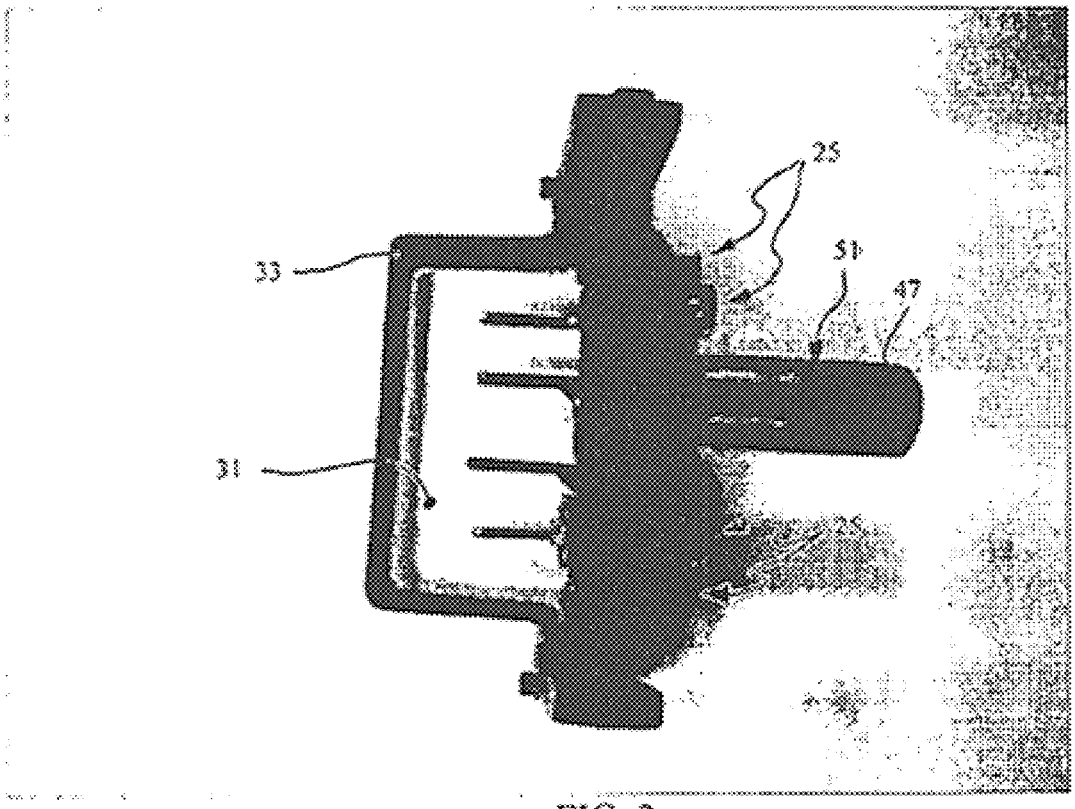
FIG. 3 is a pictorial view of a sight pin windage subassembly of the assembly of FIG. 1.

With reference now to FIGS. 3 and 4, certain details of construction of a mechanism operable to convert a user's rotational input to a pure translational output to adjust a component of a sight 21 will be discussed. Peg 47 carries one or more flat surfaces 51 for engagement with one or more interior surfaces of a bore, generally 53, passing through support element 43. Peg 47 therefore is structured in harmony with bore 53 to resist rotation of peg 47, and also to permit a pure translation of peg 47 relative to support 43. A threaded shaft 55 interfaces in engagement with internal threads aligned with an axis of peg 47. Shaft 55 and internal threads in peg 47 are one version of a linkage system operable to move peg 47 responsive to a user's rotational input onto knob 45. Such a cooperating interface between such threaded and similarly acting surfaces can be described as an inclined plane interface.

Figure 5:
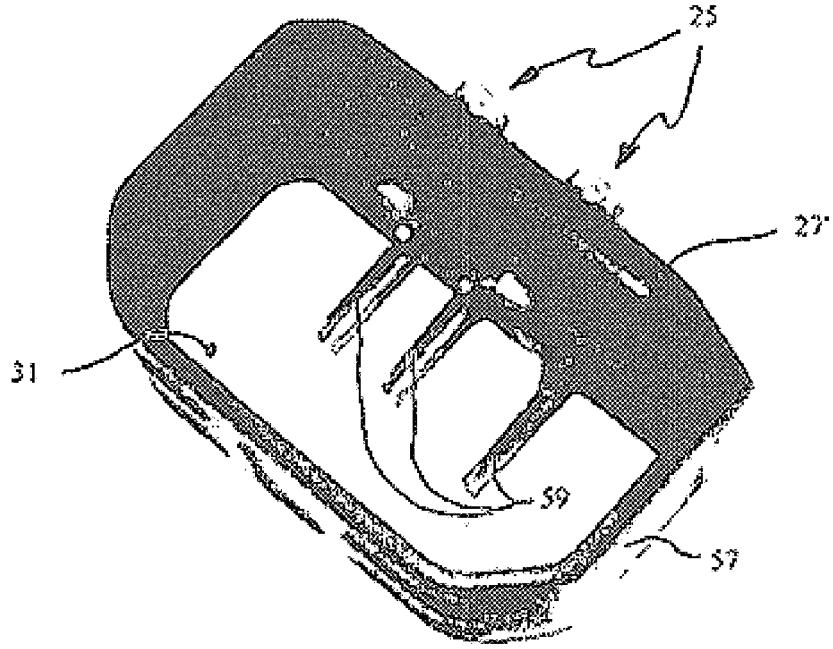
FIG. 5 is a pictorial view of a sight pin bracket assembly.

FIG. 5 illustrates an alternative embodiment of a sight cage element 57 to shield, or protect, a plurality of sight pin assemblies 25 installed on bracket 27'. As illustrated, cage 57 is integral with bracket 27'. Cage element 57 is structured to provide a deeper sight window 31 compared to cage element 33. A deeper window 31 can provide shade on sight pins 59 to prevent glare when shooting a bow outside. More secure protection is also provided by a deeper cage 57 further to resist incidental contact induced damage to light gathering elements associated with one or more of pins 59.

Figure 6:
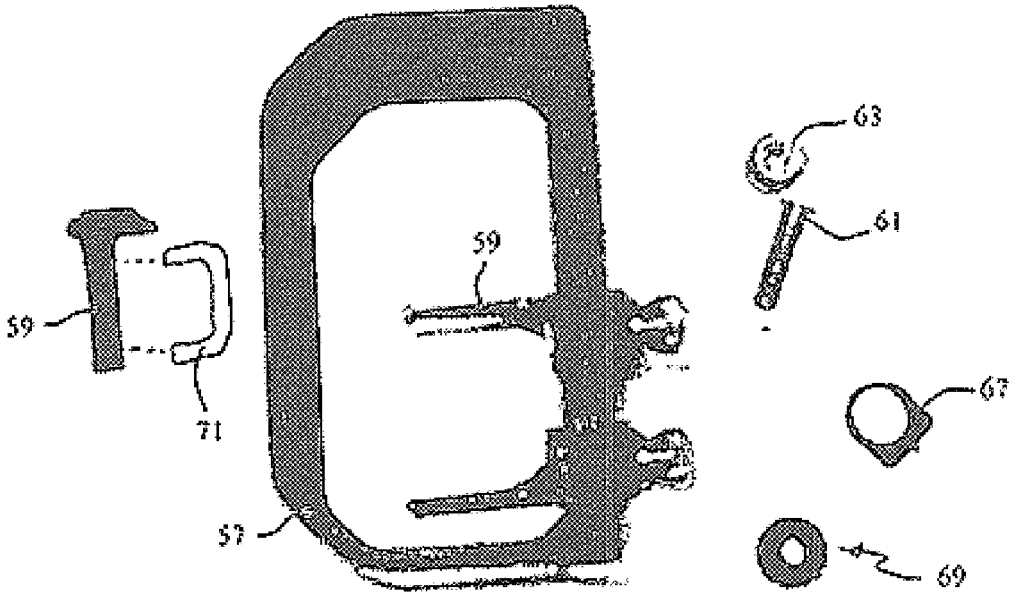
FIG. 6 is a pictorial partially exploded view of the bracket assembly of FIG. 5.
Figure 7:
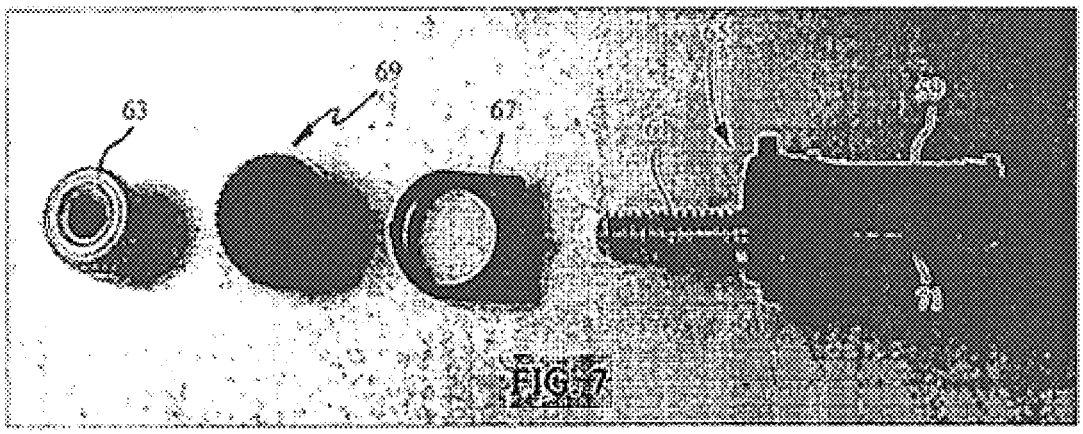
FIG. 7 is an exploded view of a sight pin assembly of the assembly of FIG. 5.

FIGS. 6 and 7 illustrate certain components of one embodiment of a sight assembly 25. A threaded stud 61 holdingly passes through the base of sight pin 59 and a bracket 27 for engagement with knurled nut 63. Structure, generally 65, on the base of pin 59 is adapted to slide, and to resist rotation of pin 59, in engagement with a slot through the bracket 27'. In the illustrated embodiment 59, structure 65 includes flat surfaces configured in harmony with sides of slot structure through bracket 27' to permit only pure translational movement of a pin 59 as an output consequential to a user's adjusting input. A washer 67 and elevation adjustment structure, generally 69, are trapped by nut 63 on an opposite side of bracket 27' from pin 59. Washer 67 may also carry alignment structure to resist rotation of washer 67 as the elevation of a pin 59 is changed.

Illustrated elevation structure 69 includes a pinion gear adapted to engage a rack formed in one side of a slot through a bracket 27 or 27'. A user can apply a rotational input to elevation adjustment structure 69 to effect a purely translational vertical adjustment of sight pin 59. Therefore, a light gathering element, such as fiber strand 71 carried by pin 59, will maintain a uniform orientation, without rotating, as the pin's elevation changes. Undesired motion of the sight pin assembly 25 may be restrained by cinching nut 63 snugly into engagement against elevation adjustment structure 69 to cause a friction engagement operable to resist rotation of structure 69 and resulting displacement of assembly 25. The nut 63 effectively acts as part of a locking arrangement to resist motion of a sight pin assembly on a bracket 27.

Figure 8:
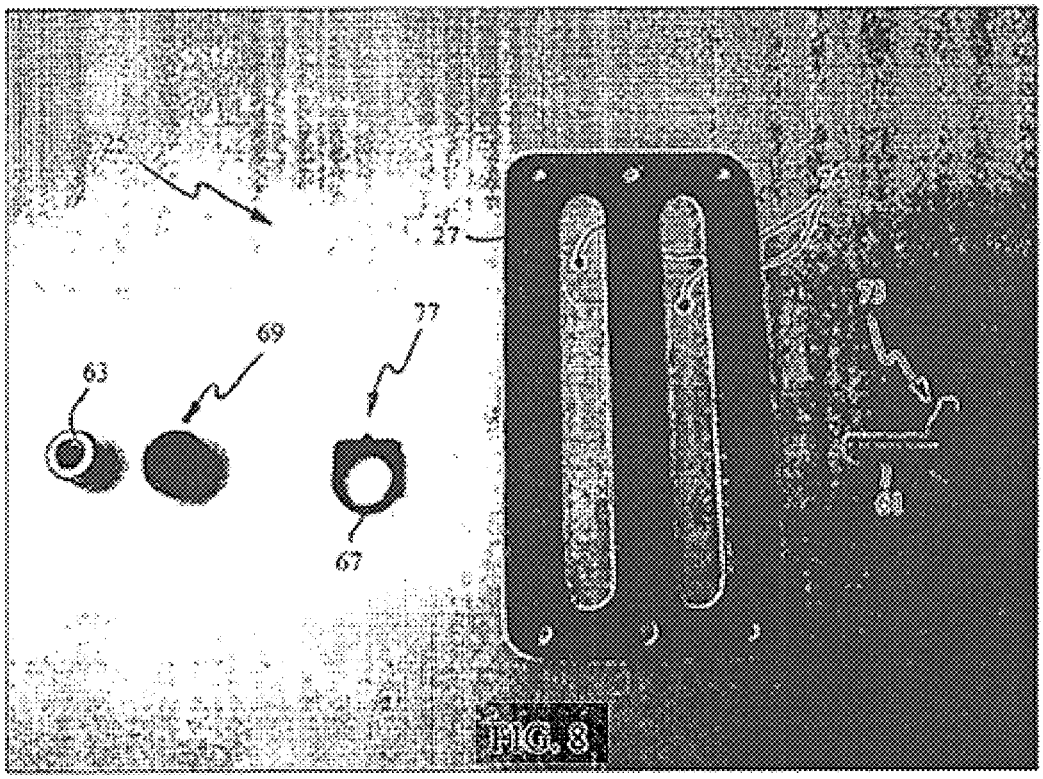
FIG. 8 is an exploded view of an sight pin bracket and sight pin assembly from an alternative embodiment of the invention.
Figure 12:
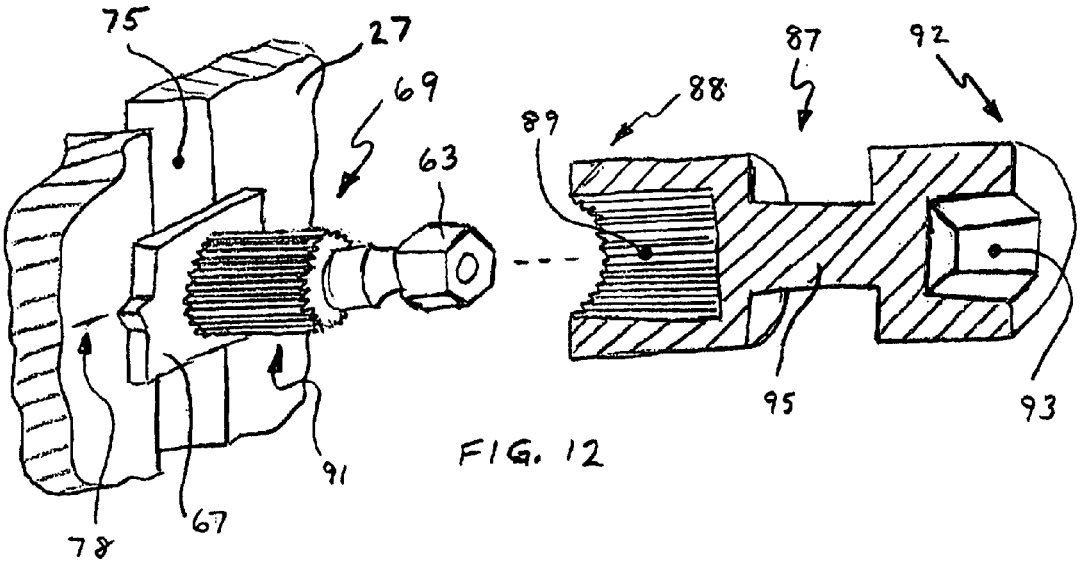
FIG. 12 is a view in perspective of an elevation adjustment mechanism and an adjustment tool.

FIG. 8 illustrates an additional alternative embodiment of structure that may be included in a sight pin assembly 25. An alternative base structure, generally 73, supportingly carries a fiber optic sight structure (not illustrated). Base 73 is mounted on bracket 27 in a similar fashion to the embodiment illustrated in FIGS. 6 and 7. Threaded post 61 passes through a slot 75 through bracket 27, and is retained by nut 63. It is currently preferred to provide an indicator structure, such as the arrow-shaped protrusion, generally 77, to provide an indication for installed sight position to an archer. In use of the indicator, an archer may sight in a pin 59 for a certain distance, then make a mark on bracket 27 at the current location of arrow 77. Alignment of a mark, generally 78, and an arrow 77 is illustrated in FIG. 12. In the event the sight assembly 25 is knocked out of such position in the field, the archer may confidently return the sight pin 59 to the sighted-in position by aligning the arrow 77 and the drawn indicating line 78.

Figure 9:
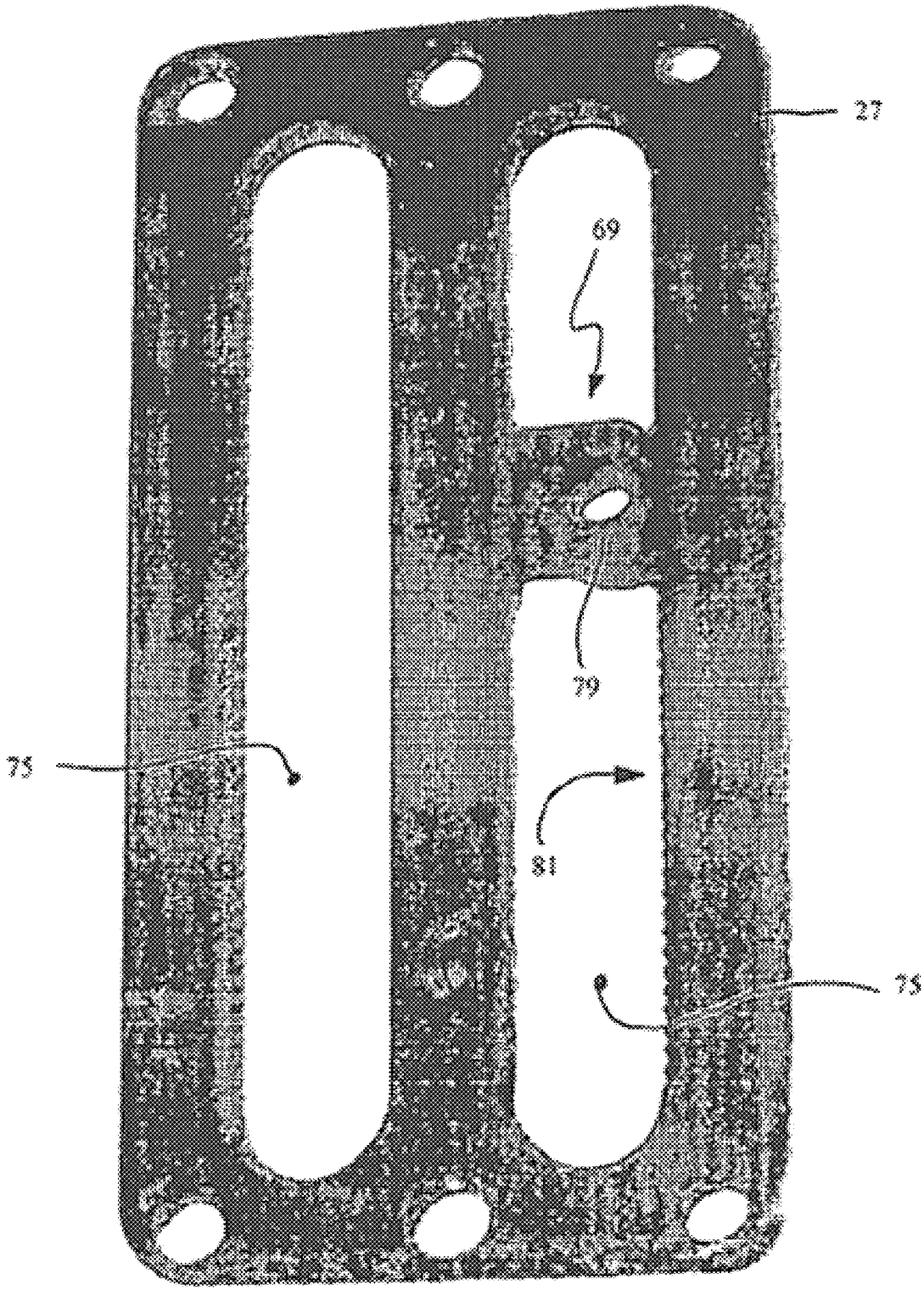
FIG. 9 is a plan view of a the bracket portion of FIG. 8 and a component of the sight pin assembly of FIG. 8.

FIG. 9 illustrates an installed operating orientation between a bracket 27 and elevation adjusting structure 69. Teeth on pinion gear 79 engage gear teeth of rack 81 in a rack and pinion interaction. Rotation of elevation adjustment structure 69 causes a change in vertical position of elevation adjustment structure 69 along slot 75 through bracket 27. A sight post 59 assembled onto structure 69 would similarly translate in a vertical direction, either up or down, depending upon direction of rotation of structure 69. Side walls of slot 75 are convenient structure operable in harmony with alignment structure 65 to resist rotation of a pin 59 during an elevation adjustment of the pin 59. A light gathering element carried on pin 59 therefore undergoes pure translational displacement effected by a user's rotational input to elevation adjustment structure 69.

Figure 10:
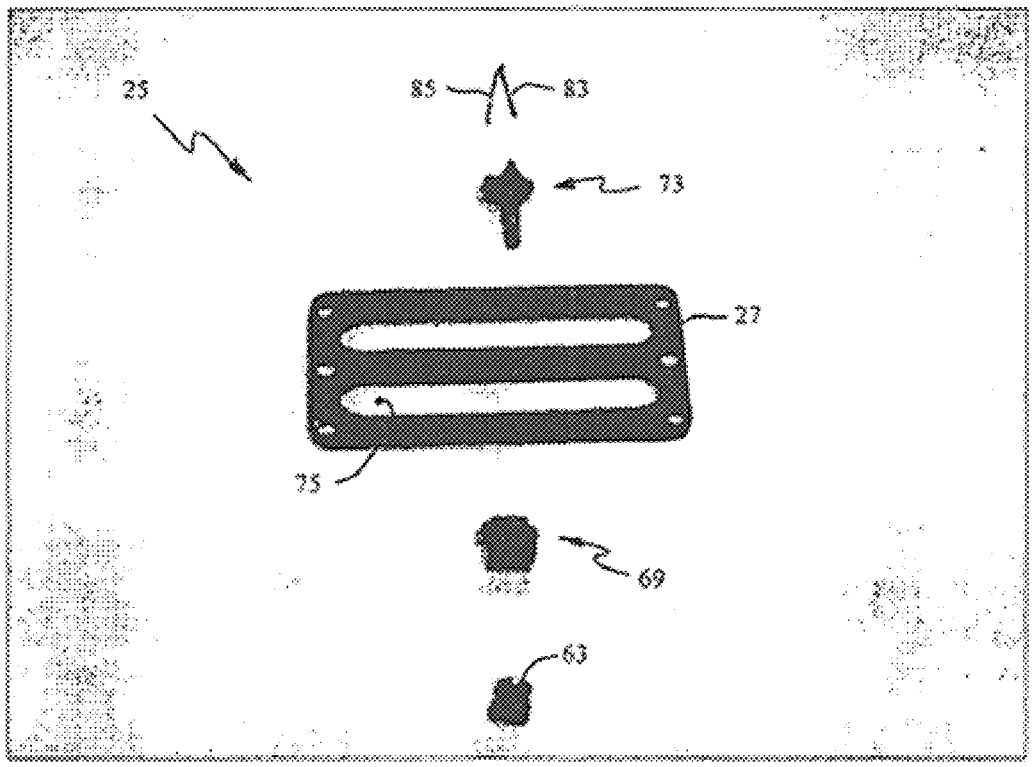
FIG. 10 is an exploded view similar to FIG. 8.
Figure 11:
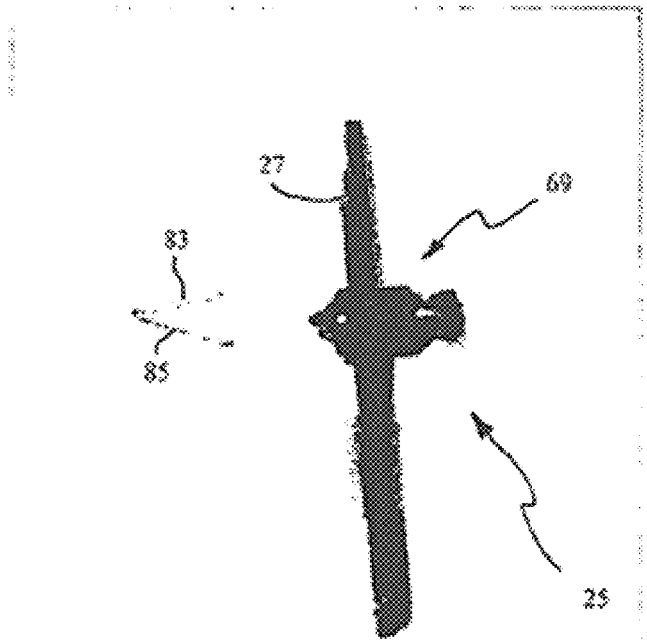
FIG. 11 is a plan view of the assembly of FIG. 10 in partially assembled condition, with the fiber optic component and its support detached.

FIGS. 10 and 11 further illustrate details of assembly for one embodiment of a sight pin assembly 25 and as also illustrated in FIG. 8. A distal end of fiber 85 is oriented and held by a distal end of post 85 to provide an illuminated spot to an archer for use as an aiming point. Pin support 73 carries fiber optic support element or post 83 without rotation as the elevation of support 73 is changed with respect to bracket 27. Correspondingly, fiber element 85, carried by post 83, is displaced vertically, up or down, without rotating, as the post 83 is displaced under influence of elevation adjustment structure 69.

A tool, generally 87 in FIG. 12, can be helpful to assist in adjusting small components of a mechanism to effect a positional adjustment of components of a sight assembly, such as assembly 21 in FIG. 1. One end 88 of illustrated tool 87 carries a splined bore 89 configured in harmony with splined shaft section 91 of elevation adjustment structure 69. Splined socket 89 is sufficiently deep to receive nut 63 and still engage surface 91. Splined shaft section 91 may be characterized as an embodiment of a driven interface to receive rotational input from a user. An oposite end 92 of tool 87 carries a faceted bore 93 configured to receive nut 63. Facets on nut 63 may be considered as forming an embodiment of a lock interface to receive rotational locking and unlocking input from a user to fix a sight pin assembly 25 at a desired position. Of course, any mutually engageable surfaces between a tool and a component forming a driven or locking interface would be workable, including surfaces providing structural interferences, or even simple frictional interaction.

Figure 13:
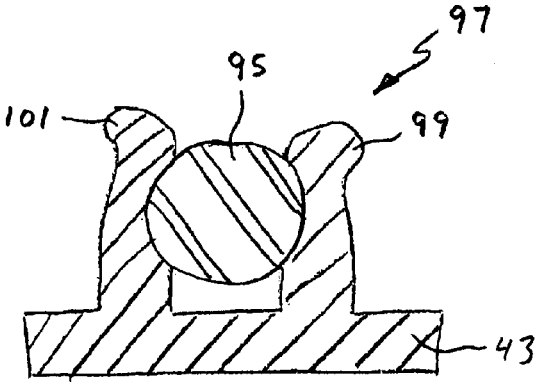
FIG. 13 is a sectional view on keeper structure to hold an adjustment tool.
Figure 14:
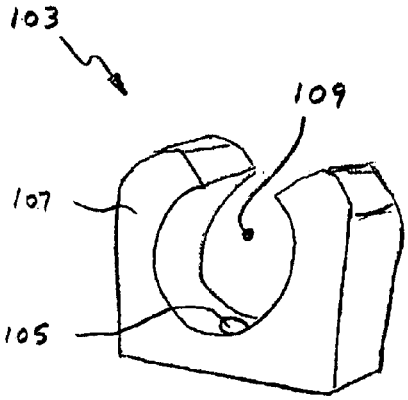
FIG. 14 is a view in perspective of alternative keeper structure to hold an adjustment tool.

When a tool 87 is provided for use with a sight assembly, it is advantageous also to provide a way to store the tool 87 for quiet transportation, and ready access for the user. One such storage structure, generally 97 grips reduced diameter shaft section 95 in a snap-fit engagement between arm 99 and arm 101. Such arms 99 and 101 may be integral to sight structure, such as the support arm 43 illustrated in FIG. 13, or may be installed at any other convenient location. One storage structure, generally 103 in FIG. 14, is capable of installation on a bracket, bow handle or riser, or any other convenient component. Storage structure 103 may be bonded to a surface, or mechanically fastened, such as through hole 105. Resilient arms 107 capture shaft section 95 of tool 87 in bore 109 for quiet transportation, and convenient, removable retention.

Figure 15:
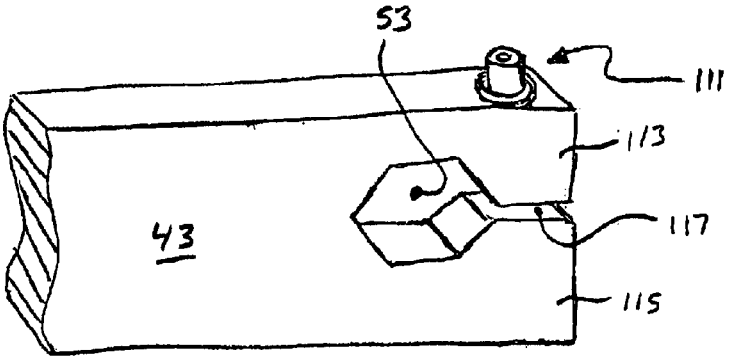
FIG. 15 is a perspective view of a portion of a support element component of a sight.

It is generally preferred to provide a way to fix a sight component at a sighted-in position. Locking arrangements typically are included in both elevation and windage adjusting mechanisms. Nut 63 clamps a vertical, or elevation adjusting mechanism 69 to form a friction lock for a sight pin assembly 25 at a desired position in a slot 75 of a bracket 27. Similarly, a locking bolt, generally 111 in FIG. 15, forms a lock interface for windage adjustment mechanism 23. Rotation of bolt 111 in a tightening direction squeezes arm 113 toward arm 115, reduces a spacing 117 between the arms, and reduces a size of bore 53. A peg 47 journaled in bore 53 can therefore be clamped, or fixed, at a desired position. Peg 47 may be marked to indicate a known, sighted-in, position, in similar fashion to making the indicator mark 78. A surface edge of bracket 43 can operate as a workable reference structure for such a mark on peg 47.

Figure 16:
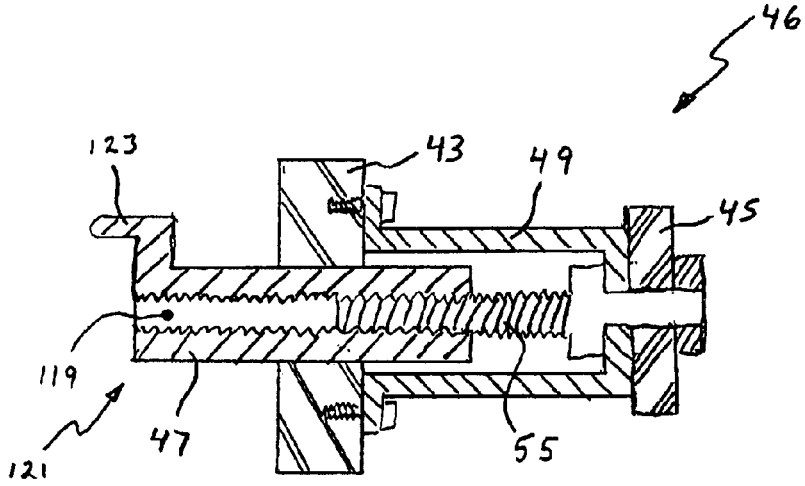
FIG. 16 is a view in section through a support element and a windage control housing.

A windage adjustment mechanism 46 is operable to make a global adjustment of all installed sight pin assemblies 25 at the same time. Such pin assemblies 25 carried on a bracket 27 desirably are moved in a horizontal direction by precisely the same amount as a windage mechanism 46 is adjusted. As illustrated in FIG. 16, a windage mechanism 46 may include a housing 49, peg 47, threaded shaft 53, and a control knob 45. Rotation of knob 45 correspondingly rotates threaded shaft 55 inside threaded bore 119 of peg 47. Peg 47 therefore slides in, or out, transversely through bore 53 in support bracket 43, depending upon direction of rotation of knob 45. A bracket 27 carried at distal end 121 of peg 47 therefore effects a global horizontal, or transverse, displacement of its mounted sight pin assemblies 25.

Figure 17:
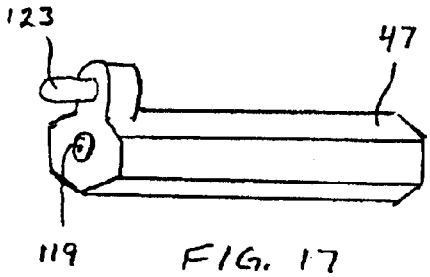
FIG. 17 is a perspective view of a peg.
Figure 18:
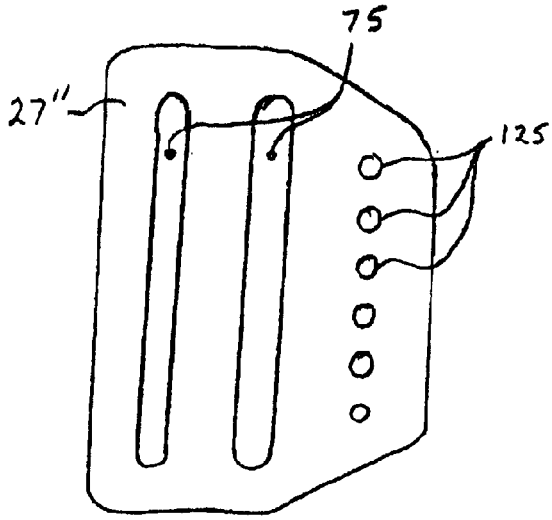
FIG. 18 is a plan view of an alternative bracket configured for simultaneous vertical adjustment of a plurality of sight pin assemblies.

A similar global change in elevation of sight pin assemblies 25 can be made on certain embodiments of the invention. As illustrated in FIGS. 16-18, a dowel 123 further may be included on a peg 47. Such a dowel may index with a hole 125 in a bracket 27". The peg 47 may be affixed to the bracket 27" by a fastener passing through a second hole 125 for engagement with bore 119. A global change in elevation of a plurality of sight pin assemblies may be accomplished by attaching the peg 47 at a different indexed location on bracket 27".

While the invention has been described in particular with reference to certain illustrated embodiments, such is not intended to limit the scope of the invention. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. In an archery bow sight of the type in which a sight pin is included in a pin assembly, mounted within a slot in a bracket, as a mechanism structured and arranged such that an elevation of the sight pin is adjusted by turning elevation adjustment structure of the sight pin assembly either clockwise or counterclockwise, the improvement comprising:

mounting a light gathering element in association with said sight pin assembly through linkage constructed and arranged to hold said element in a fixed rotational position without regard to rotation of said elevation adjustment structure; whereby:

said light gathering element travels vertically with said sight pin proximate a sight plane;

wherein said elevation adjustment structure includes an element mounted to rotate within and interact with said slot.

2. The improvement according to claim 1, wherein said sight pin assembly includes a pinion member, a side edge of said slot is fashioned as a rack member, and said pinion member and said rack member are mutually arranged to adjust the elevation of said sight pin through a rack and pinion interaction.

3. The improvement according to claim 1, further comprising:

a plurality of sight pins disposed in association with said bracket; and said bracket is configured and arranged in harmony with structure carried by a support arm for attachment of said bracket in a plurality of vertical positions with respect to said support arm, whereby moving said bracket between two such vertical positions simultaneously effects a corresponding uniform displacement on all said sight pins.

4. The improvement according to claim 3, further comprising:

a windage adjustment mechanism including a peg extending from said bracket and reciprocally mounted within a housing carried by said support arm, said housing further containing a mechanism constructed and arranged to couple with said peg such that rotation of a knob associated with said housing effects linear extension or retraction of said peg with respect to said housing, depending upon a direction of rotation of said knob.

5. In an archery bow sight of the type in which a plurality of sight pins are included in a plurality of pin assemblies mounted within a slot in a bracket by structure arranged such that the elevation of the sight pins are individually adjustable, the improvement comprising:

mounting said bracket to an archery bow by means of a mounting assembly including a support arm having a distal end carrying a windage adjustment mechanism including a peg extending from said bracket and reciprocally mounted within a housing at said distal end, said housing further containing a mechanism constructed and arranged to couple with said peg such that rotation of a knob associated with said housing is translated to effect a linear extension or retraction of said peg with respect to said housing and thereby effect a corresponding horizontal movement of all said pins, depending upon a direction of rotation of said knob; wherein:

effecting said extension or retraction of said peg with respect to said housing require a corresponding rotation of said knob.

6. The improvement according to claim 5, wherein said mechanism includes an inclined plane interface between a first component associated with said peg and a second component associated with said knob.

7. The improvement according to claim 6, wherein said incline plane interface is provided by an internal threaded surface of said peg interacting with the external threads of a shaft driven by said knob.

8. An improved sight for an archery bow, the improvement comprising:

a mechanism associated with said sight and operable to convert a rotational user input into a purely translational output, whereby to adjust a component of said sight, said mechanism comprising a windage adjustment mechanism operable simultaneously and uniformly to effect a horizontal adjustment of a plurality of sight pins;

said plurality of pins being carried on a base structure adapted for attachment, at a plurality of vertically disposed positions, to structure carried by a support arm of said sight, whereby to permit a simultaneous and uniform displacement of said pins in a vertical direction;

said mechanism comprises an elevation adjustment mechanism operable to effect a vertical adjustment of a sight pin; and said elevation adjustment mechanism comprising a pinion engaging a rack.

9. The sight of claim 8, wherein:

said elevation mechanism further comprises a lock adapted to resist changes in said vertical position of said pin, said lock being operated by a lock interface that is adapted to receive rotational locking and unlocking input from a user.

10. The sight of claim 9, in combination with a wrench adapted on a first end to apply a rotational input to said driven interface, and adapted on a second end to apply a rotational input to said lock interface.

11. The sight of claim 10, wherein:

said sight further comprises storage structure adapted to hold said wrench in a snap-fit engagement.

12. The sight of claim 8, further comprising:

a light gathering element disposed in association with said sight pin for purely vertical translation between first and second elevations.

13. The sight of claim 8, said mechanism comprising:

a knob element adapted to receive rotational input from a user;

a slide member configured and arranged in harmony with holding structure to resist rotation of said slide member and to permit translational movement of said slide member with respect to said holding structure; and linkage structure between said knob and said slide member, said linkage structure being operable to move said slide member responsive to rotation of said knob.

14. In an archery bow sight of the type in which a plurality of sight pins are mounted within a bracket such that the elevation of the sight pins are individually adjustable, the improvement comprising:

mounting said bracket to an archery bow by means of a windage adjustment mechanism including a peg element reciprocally mounted within a housing such that turning of an adjustment knob associated with said housing effects non-rotational linear extension or retraction of said peg element with respect to said housing, depending upon the direction of rotation of said knob and effecting said extension or retraction of said peg with respect to said housing requires a corresponding rotation of said knob.

* * * * *